US011478903B2

(12) United States Patent
Buchanan

(10) Patent No.: US 11,478,903 B2
(45) Date of Patent: Oct. 25, 2022

(54) PLIERS

(71) Applicant: Nigel Buchanan, Fife (GB)

(72) Inventor: Nigel Buchanan, Fife (GB)

( * ) Notice: Subject to any disclaimer, the term of this patent is extended or adjusted under 35 U.S.C. 154(b) by 124 days.

(21) Appl. No.: 16/630,083

(22) PCT Filed: Jul. 10, 2018

(86) PCT No.: PCT/GB2018/051961
§ 371 (c)(1),
(2) Date: Jan. 10, 2020

(87) PCT Pub. No.: WO2019/012272
PCT Pub. Date: Jan. 17, 2019

(65) Prior Publication Data

US 2020/0206879 A1 Jul. 2, 2020

(30) Foreign Application Priority Data

Jul. 10, 2017 (GB) ..... 1711102
Oct. 30, 2017 (GB) ..... 1717866

(51) Int. Cl.
*B25B 7/12* (2006.01)
*B25B 7/08* (2006.01)
*B25B 7/14* (2006.01)

(52) U.S. Cl.
CPC ..... *B25B 7/12* (2013.01); *B25B 7/08* (2013.01); *B25B 7/14* (2013.01)

(58) Field of Classification Search
CPC .... B25B 7/12; B25B 7/08; B25B 7/14; B25B 7/16; B25B 7/18; B25B 7/00; B25B 7/04; B25B 7/02
See application file for complete search history.

(56) References Cited

U.S. PATENT DOCUMENTS 3,282,137 A * 11/1966 Lovelace ..... B25B 7/12 81/302
5,887,492 A * 3/1999 De Laney ..... B25B 7/00 81/13
8,677,865 B2 * 3/2014 Buchanan ..... B25B 7/10 81/407
9,272,394 B2 * 3/2016 Buchanan ..... B25B 7/14
2009/0178518 A1 * 7/2009 Buchanan ..... B25B 7/123 81/324
2012/0291293 A1 * 11/2012 Nashimoto ..... B25B 7/00 30/272.1

* cited by examiner

*Primary Examiner* — Robert J Scruggs
(74) *Attorney, Agent, or Firm* — Patterson Intellectual Property Law, P.C.; Emily A. Shouse

(57) ABSTRACT

A pliers has jaw portions incorporating gripping faces for the clamping of the desired workpiece, two pivotal handle portions and a sprung toothed strut positioned between the handles. A bow shaped resilient portion, incorporated within the second arm portion, when the pliers are operated this resilient portion imparts a useful superior sprung pressure upon the clamped workpiece by the gripping face of the jaws. The second arm and bend promoting portion are contiguous with each other. The jaws can further be usefully locked in the required clamping position upon the workpiece by a toothed sprung strut pivotally attached to the first and second arms and conveniently being locked or unlocked according to the locking switch pivotal within the first arm.

7 Claims, 8 Drawing Sheets

PLIERS

FIELD OF INVENTION

The invention relates to hand operated gripping tools, gripping tools that are adjustable within the range of the jaws of the tool. One form of hand operated gripping tool of the locking type generally referred to as locking pliers which are colloquially known as vice grip pliers.

BACKGROUND TO THE INVENTION

Existing "vice grip" pliers have the common characteristic of jaws initially adjusted by a screw on the end of the fixed handle, the closure of the moving handle operating an over-cam mechanism to lock the jaws upon the workpiece, the prior adjustment of the screw determining the locking pressure of the said jaws upon the workpiece, several adjustments usually being required to attain the required gripping pressure.

Further types of pliers are adapted to slideably close upon a workpiece in response to manual closing of the handles and in response to contact with the workpiece, automatically lock against further sliding action by engaging suitable teeth and thereby shift from a sliding to a pivoting mode whereby continued exertion of manual force on the handles increases the gripping action upon the workpiece.

Existing locking pliers such as those shown in US2015/283681 (Wu) and US2015/273664 (Skodje et al) comprise two robust handles connected to two robust jaws, and a locking mechanism connected to the two jaws. The handles can be squeezed to close the jaws. The locking member is attached to an over centre linkage which when utilized prevents the lower handle from pivoting from its closed configuration and until opened retaining the jaws in a closed position. The clamping width of the jaws being adjusted by an adjustment screw, the adjustment screw further determining the clamping pressure exerted upon the clamped workpiece. As the clamping pressure requires to be preordained, it can take several attempts to correctly adjust the screw to the required position in order to clamp the workpiece the optimum way. The clamping width of the jaws once set by the adjusting screw is finite, any movement, vibration or relaxing of the clamped material normally resulting in the failure of the clamping action, this is most prevalent when the device is used to initially clamp bodywork parts during the panel beating process prior to welding or bolting the panels being worked on, inadvertent over pressure applied by the clamping jaws usually resulting in the damage or distortion of the clamped parts.

U.S. Pat. No. 7,421,923 (Engel) shows a set of pliers having a toothed strut with a locking mechanism attached to one operating arm, as the arms are closed the teeth "ratchet" past the lock, as the operating arms are not designed to resiliently deform during robust operation, the toothed arc of the strut remains in substantially the same locking angle relative to the locking mechanism.

U.S. Pat. No. 9,272,394 (Buchanan) discloses pliers or clamps having a single bow or arcuate portion to permit limited flexing of one of the handles. A pivotal strut is retained between the handles, the strut slidably held in a channel within one handle and pivotally held within the other handle, the pivotal end of the strut having a toothed arc which acts with a further switched pawl to lock or unlock the handle positions relative to one another. The compression of the handles closing the gap between the fixed and moveable jaws, the moveable jaw sliding up a clamp bar portion until the jaws robustly contact the workpiece, the further operation of the handles resulting in the clamping of the workpiece, the resilient arcuate portion acting to impose a limited sprung grip upon the workpiece, further usefulness imported by the locking action of the pawl teeth within the strut arc teeth when the pawl is switched into its ratchet locking position retaining the handles substantially in their closed position providing a limited spring grip upon the workpiece. These pliers although efficient are expensive and complex to manufacture.

It is an object of the invention to at least partially alleviate the above-mentioned disadvantages, or to provide an alternative to existing products. Pliers according to embodiment of the invention may provide a more cost-effective product capable of more than one function.

SUMMARY OF THE INVENTION

According to the invention a set of pliers may comprise jaw portions incorporating gripping faces within the opposing jaws for the clamping of the desired workpiece or workpieces, pivotal handle portions which are pivotal around an axis pin. Bow shaped resilient portion or portions are usefully incorporated within either or both the jaw or handle portions, when the pliers are operated these resilient portions impart a useful superior elastic potential energy pressure upon the clamped workpiece by the gripping face of the jaws. The Jaws and bend promoting portion are contiguous with each individual handle and gripping portion. The jaws can further be usefully locked in the required clamping position upon the workpiece by a toothed sprung strut pivotally attached to the first handle and conveniently being locked or unlocked according to the locking switch pivotal within the fixed or first handle.

The invention may include an intuitive switch locking/unlocking mechanism utilizing less parts than previous pliers type tools comprising pivotal struts with toothed arcs interacting with a switch. The switch usefully now directly incorporates a locking, ratcheting or disengaged teeth mechanism according to its chosen orientation, which can be usefully utilized as required to engage with the teeth of the toothed strut arc to positionally to lock as required the same, thereby locking the clamped workpiece within the jaw portions, or alternately disengaging the switch teeth from the strut toothed arc releasing the workpiece from the jaws, according to the pivotal switch orientation.

A first embodiment of the invention provides pliers comprising a switch incorporating a ratchet function, the switch incorporating a bore for the engagement of a positional pin and its compression spring, the positional pin being free to move lengthwise within the bore against the resilient force of the spring. In best practice the outer end of the positional pin is rounded or angled with a blunt point for ease of movement against a corresponding peaked engagement profile. The pin having a close sliding fit within the bore whereas it can easily traverse inwards or outwards against the spring within the bore according to the engagement between the blunt point and the corresponding peaked engagement profile mounted within the handle. The said switch engagement profile further comprising of a transition peak with a sloping open profile on one side and a switch closing profile on the other, the pivotal switch can be manually intuitively operated by the operator from either chosen position, during the switch positional operation the positional pin is propelled into the switch bore against the incumbent spring as its outward blunt point moves against the corresponding upwardly sloping engagement profile till it traverses the peak of the engagement profile and consequently now engages the downwardly sloping engagement profile at the other side of the peak, the switch spring usefully resiliently propelling the positional pin blunt outward end against its corresponding sloping engagement profile positively resiliently engaging or disengaging the switch teeth from the toothed strut arc teeth according to the operators requirements.

As it is commercially prudent to have a ratchet like clicking noise to accompany the jaw closure and locking procedure the interaction of the resiliently biased switch teeth with the corresponding pivotal strut toothed arc teeth, when the switch is in the closing position provides a typical ratchet like sound as the strut rotates during the closure procedure around the strut axle against the resilience of the strut spring.

The invention may incorporate a very cost effective "ratcheting switch mechanism" utilizing minimum parts. The pliers clamping widths within its specification are automatically adjusted, the locking pressure can be further be usefully determined by the operator by the straightforward gripping pressure of the handles, the simple release of the handles initiating the locking of the jaws upon the clamped parts. The utilization of bowed resilient portions within the handle or handles providing superior constant jaw clamping pressure of the part or parts clamped whilst normally preventing surface damage to the parts claimed. The present invention further works on a reasonable range of workpiece sizes and shapes whilst optionally utilizing superior sprung gripping force of the workpiece. Furthermore, the main parts are capable of being stamped or made by high pressure moulding HPM or metal injection moulding MIM in order to further reduce their cost.

Another embodiment of the invention provides pliers comprising of a first and second arm pivotal around an axle pin the pivot point biased towards the jaws end, the first and second arm handle portions further connected by a pivotal strut, the first arm comprising a jaw element, the first arm handle element further comprising a recess containing a switch operating a toothed pawl which can be engaged or disengaged within the teeth of the strut toothed cam by the operation of the said switch, the strut resiliently biased by a strong extension spring attached to the strut toothed cam and at its distal end attached to the first handle, the strut having an outer cam which acts against the second arm strut cam channel profile and retained within the strut channel pin slot by a strut cam pin, the pivot pins through the toothed pawl, switch, strut toothed cam and outer cam can also be usefully incorporated within the said pivotal parts. When the switch is in the deactivated position the strut is resiliently biased by the extension spring attached to the strut toothed cam, urging the second arm handle portion outwards from the first arm as the strut outer cam is propelled up against the second arm strut cam channel profile and retained within the strut cam pin slot, the second arm is further propelled outwards from the first arm handle around the axle pin, fully opening the first and second jaw elements relative to one another. The strut spring could be alternately employed in other positions but the position chosen is the simplest and most protected.

Still another embodiment of the invention provides locking pliers comprising a first and second arm, the first arm comprising a jaw element contiguous to the handle element further comprising a recess containing a switch operating a toothed pawl which can be engaged or disengaged within the teeth of the strut toothed cam. The operation of the said switch means that the pliers can usefully be used as normal or locking pliers according to the switch position. The strut resiliently biased by an extension spring attached to the strut toothed cam and at its distal end attached to the first handle, the strut having an outer cam which acts against the second arm strut cam channel profile and retained within the strut channel pin slot by a strut cam pin, the pivot pins through the toothed pawl, switch, strut toothed cam and outer cam can also be usefully incorporated within the said pivotal parts. When the switch is in the activated position the resiliently propelled switch actuator pin acts upon the toothed pawl actuating profile which in turn resiliently biases the toothed pawl teeth to mesh with the correspondingly profiled strut toothed cam in order to work as a ratcheting device. As the first and second handles are operated and forcefully propelled towards one another against the resiliently biased extension spring attached to the strut toothed cam. The strut toothed cam ratcheting against the resiliently biased toothed pawl during its pivotal movement. The strut outer cam is further driven down the second arm channel profile according to the applied operator gripping force, this motion further rotates the strut toothed cam in a ratcheting manner against the resiliently biased toothed pawl robustly holding the second handle in position relative to the first handle when the operator gripping pressure is released and the strut is locked in position by the toothed pawls engagement upon the strut toothed cam. The switch can further positioned whereas the toothed pawl teeth are disengaged from the strut teeth allowing the pliers to be conveniently used as normal non-locking pliers.

Yet another embodiment of the invention provides pliers comprising pliers jaws held closed under a useful resilient gripping tension during the locking or non-locking pliers operation. The pliers second arm incorporating an arc or bowed section which has a width from about 5% to 80% thinner than the rest of the second arm. In best practice the bowed portion is situated between the second arm axle hole and the handle gripping portion and constructed from suitable spring steel material, the profile, material and thickness of the produced clamp resilient portion or living spring is carefully chosen in order to provide a repeatable resilience with little chance of stress cracking during repeated use. The resilient portion is in the form of a slow curve or arc in the direction of the third handle closure force. The second handle can be further usefully locked in the chosen jaw elements clamping pressure position, the pivotal strut is rotatable around its axle pin when the first and third handles are clenched closing the jaw elements upon the workpiece etc. As the said handles are further activated the second arm pivots around its pivot pin and the strut outer cam slides down against the second arm cam channel profile further guided within the second handle strut cam pin slot by the strut outer cam having a retention pin or pin like protrusions fitted for this purpose. The strut toothed cam teeth "ratchet" over the corresponding teeth on the sprung toothed pawl according to the pressure applied to the said handles. When the operator has reached the level of clamping required and releases the applied grip of the said handles, the ratchet teeth of the toothed pawl and the strut toothed cam engage in a locking manner. The flex induced within the bowed portion or living spring and the enduring clamping of the jaw elements upon the clamped parts is retained by the angle of the locked strut and the retention pin within the strut outer cams further engagement within the strut cam pin slot wherein the tension or potential energy within the bowed second arm portion is therefore retained for the purposes of placing the jaws under useful resilient gripping tension. If the clamped parts were subjected to movement or vibration which would defeat the fixed clamping effect of prior art vice grip pliers the present device would still retain its grip albeit a lesser one, the clamping action of the jaws being further determined by the remaining resilience of the bowed portion, the elastic potential energy. The resultant jaw resilient closing force is largely proportional to the force applied to the first and second handles and the pivotal dimension ratio between the first and second handle portions and the levered first and second jaw portions, less any small losses incurred during the switch locking procedure.

Another embodiment of the invention provides pliers in which there is no handle resilient portion incorporated, the pliers operation still being switchable between locking and unlocking.

Another embodiment of the invention provides pliers in which the teeth profiles used by the toothed pawl are saw like in profile in that the locking face of the teeth used are over upright and need to relieved of locking tension by squeezing the handle grips before the switch can be deactivated or released, this further acts as an efficient safety lock feature.

The pliers may comprise an intuitive switch locking/unlocking mechanism directly incorporating a locking, ratcheting or disengaged switch teeth mechanism according to its chosen orientation, which can be usefully utilized as required to engage with the teeth of the toothed strut cam to lock in position as required the same, thereby locking the clamped workpiece within the jaw portions, or alternately disengaging the switch teeth from the strut toothed arc releasing the workpiece from the jaws, according to the pivotal switch orientation.

The pliers may comprise a switch further incorporating a bore for the engagement of a biasing pin and its compression spring, the biasing pin being free to move lengthwise within the biasing pin bore against the resilient force of the spring, in best practice the outer end of the biasing pin is rounded or angled with a smooth blunt point for ease of movement against a corresponding peaked engagement profile, the pin having a close sliding fit within the bore whereas it can easily traverse inwards or outwards against the spring within the bore according to the engagement between the blunt point and the corresponding switch biasing block engagement profile mounted within the first handle, the said switch biasing block profile further comprising of a transition peak with a sloping opening profile on one side and a sloping switch closing profile on the other, the pivotal switch can be manually intuitively operated by the operator from either chosen position, during the switch positional operation the biasing pin is propelled into the switch bore against the incumbent spring as its outward blunt point moves against the corresponding upwardly sloping engagement profile of the biasing block till it traverses the peak of the engagement profile and consequently now engages the downwardly sloping engagement profile at the other side of the peak, the switch spring usefully resiliently propelling the biasing pin blunt outward end against its corresponding biasing block sloping engagement profile positively resiliently engaging or disengaging the switch teeth from the toothed strut cam teeth according to the operators requirements.

REFERENCE TO THE DRAWINGS

For the ready reference of the reader the reference numerals have been arranged in ascending numerical order.

| | |
|---|---|
| 1 | Pick-Up-Go Pliers |
| 20 | First Arm |
| 21 | First Jaw Portion |
| 22 | First Arm Handle |

-continued

| | |
|---|---|
| 23 | First Arm Outer Plates |
| 24 | First Arm Axle Hole |
| 25 | First Arm Jaw Inner |
| 26 | First Jaw Gripping Portion |
| 27 | First Arm Spacer |
| 28 | First Arm Handle Spacer |
| 29 | First Arm Assembly Holes |
| 300 | Second Arm |
| 301 | Second Arm Jaw Portion |
| 302 | Second Arm Handle |
| 303 | Second Jaw Gripping Portion |
| 304 | Resilient Portion |
| 305 | Strut Cam Pin Slot |
| 306 | Strut Cam Channel Profile |
| 307 | Second Arm Handle Outer Plates |
| 308 | Second Arm Jaw Outer Plates |
| 309 | Second Arm Axle Hole |
| 310 | Second Arm assembly Holes |
| C | Clenching Face |
| G | Gripping Face |
| U | Switch Unlocked Position |
| L | Switch Locked Position |
| R | Ratcheting Function |
| A | Triangular Elastic Potential Energy Structure |
| 40 | Strut |
| 41 | Strut Pivot |
| 42 | Strut Retention Pin |
| 43 | Strut Toothed Cam |
| 44 | Strut Toothed Cam Teeth |
| 45 | Strut Distal End Cam |
| 500 | Switch |
| 501 | Switch Axle |
| 502 | Switch Biasing Block |
| 503 | Switch Teeth |
| 504 | Biasing Pin Bore |
| 505 | Switch Actuator |
| 506 | Biasing Pin |
| 507 | Biasing Pin Actuating End |
| 508 | Biasing Pin Sprung Abutment End |
| 509 | Biasing Block Closing Profile |
| 510 | Biasing Block Open Profile |
| 511 | Biasing Block Transition Peak |
| 60 | Axle Pin |
| 61 | Assembly Rivets |
| 70 | Strut Spring |
| 71 | Switch Spring |
| 80 | Workpiece |
| 81 | Metal Plate Workpieces |

REFERENCE TO THE DRAWINGS

For the ready reference of the reader the reference numerals have been arranged in ascending numerical order.

Pliers 1 comprising of a First Arm 20, First Jaw Portion 21, First Arm Handle 22, First Arm Outer Plates 23, First Arm Axle Hole 24, First Arm Jaw Inner 25, First Jaw Gripping Portion 26, First Arm Spacer 27, First Arm Handle Spacer 28, First Arm Assembly Holes 29, Second Arm 300, Second Arm Jaw Portion 301, Second Arm Handle 302, Second Jaw Gripping Portion 303, Resilient Portion 304, Strut Cam Pin Slot 305, Strum Cam Channel Profile 306, Second Handle Outer Plates 307, Second Arm Jaw Outer Plates 308, Second Arm Axle Hole 309, Second Arm Assembly Holes 310, Strut 40, Strut Pivot 41, Strut Retention Pin 42, Strut Toothed Cam 43, Strut Toothed Cam Teeth 44, Strut Distal End Cam 45, Switch 500, Switch Axle 501, Switch Biasing Block 502, Switch Teeth 503, Biasing Pin Bore 504, Switch Actuator 505, Biasing Pin 506, Biasing Pin Actuating End 507, Biasing Pin Sprung Abutment End 508, Biasing Block Closing Profile 509, Biasing Block Open Profile 510, Biasing Block Transition Peak 511, Axle Pin 60, Assembly Rivets 61, Strut Spring 70, Switch Spring 71, Clenching Face C, Gripping Face G, Switch Unlocked Position U, Switch Locked Position L, Ratcheting Function R, Triangular Elastic Potential Energy Structure A.

BRIEF DESCRIPTION OF THE DRAWINGS

The drawings show examples of pliers according to the invention as follows.

DETAILED DESCRIPTION

As required, detailed embodiments of the invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the invention. FIGS. 1 to 8 display the various embodiments of the present invention.

Figure 1:
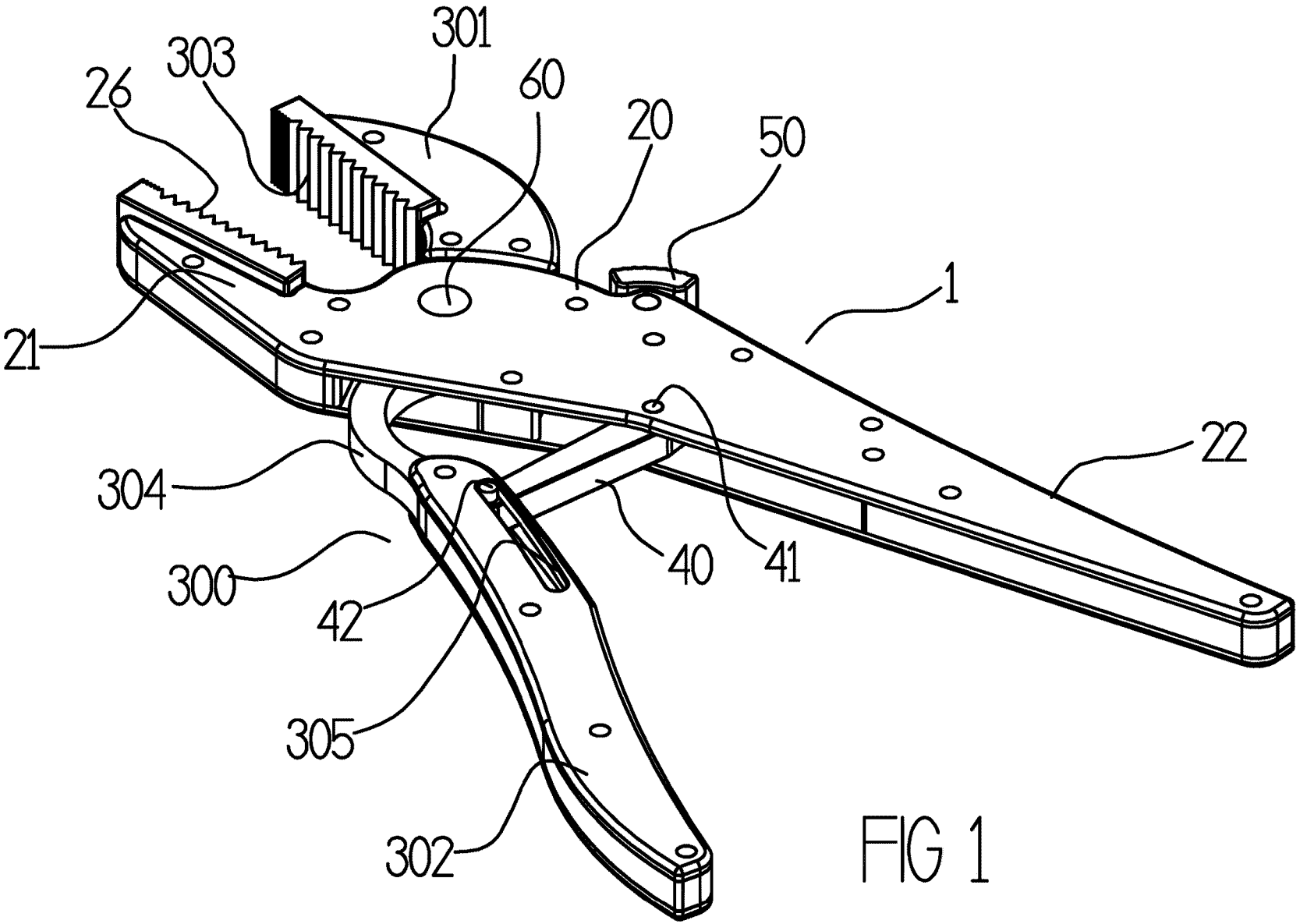
FIG. 1 is a perspective view of an embodiment of pliers according to the invention.

FIG. 1 illustrates the pliers 1 at rest. Showing the first arm 20, the first jaw element 21 with its gripping face 26. The pivotal switch 50, strut 40 and its strut pivot 41. The second arm 300 is pivotal to the first arm 20 around the axle pin 60. The second arm jaw element 301 with its gripping face 303 is contiguous within the second arm 300. The second arm 300 further retains the strut distal end cam retention pin 42 within its pin slot 305, further displayed is the second arm resilient portion 304, first arm handle 22 and second arm handle 302. Further shown are the strut 40 rotatable around its pivot 41.

The pliers 1 may further incorporate clamping widths within its specification that are automatically adjusted, the locking pressure can be further be usefully determined by the operator by the straightforward gripping pressure of the said arm handle portions 22, 302 the simple release of the said handles 22, 302 initiating the locking of the said jaws 21, 301 when the switch 50 is in the locking position L.

Figure 2:
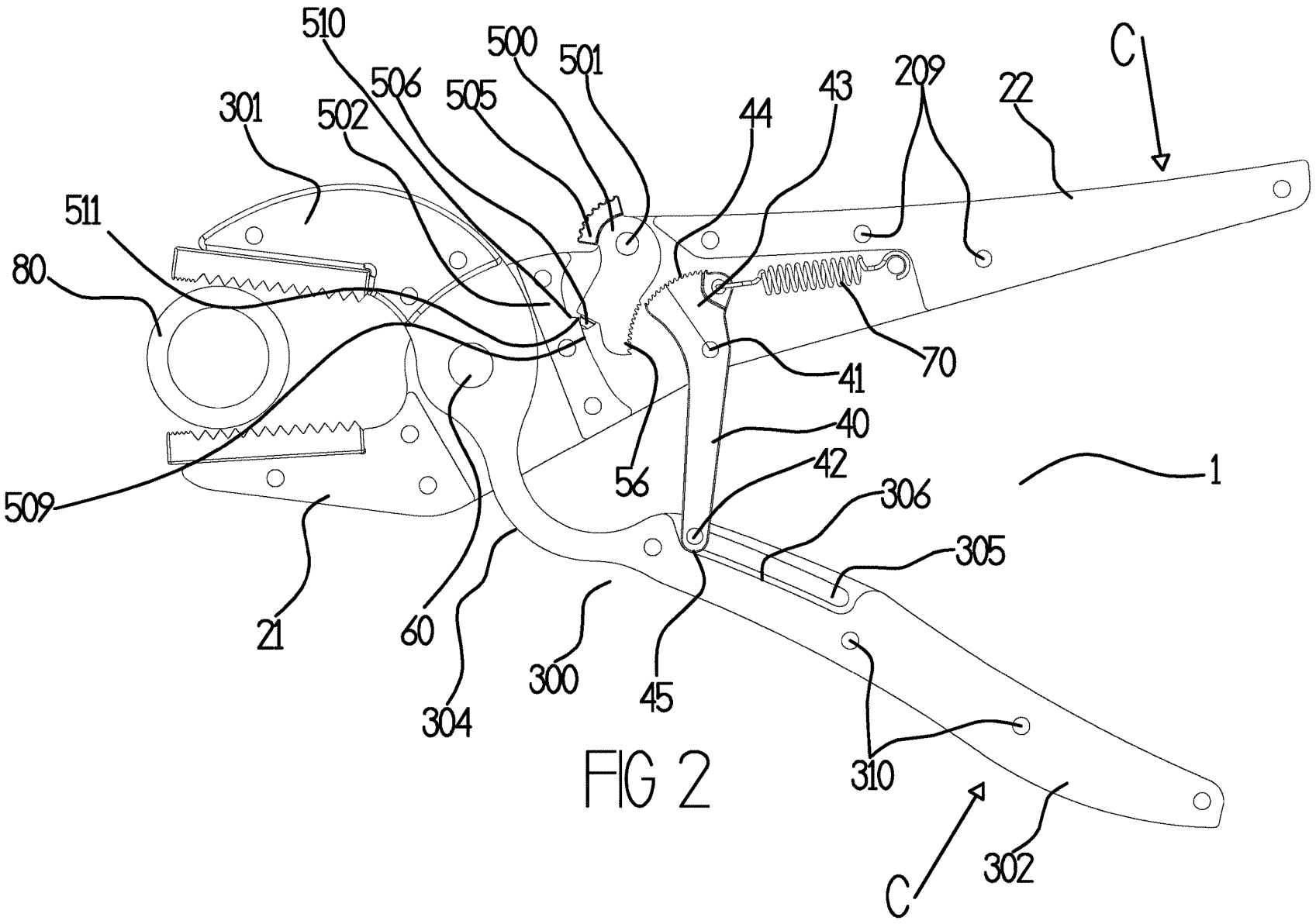
FIG. 2 is a plan view of the pliers shown gripping a workpiece with the first and second arm top plates/top laminates shown removed for illustration purposes.

FIG. 2 shows the pliers 1 gripping a workpiece 80, the top plates 23, 307 (not shown) being removed for illustration purposes.

The pliers 1 may comprise a switch mechanism 500 which is pivotally attached within the first arm 20. The first jaw element 21 is contiguous with the first arm handle 22 and the corresponding second jaw element 301 contiguous to the second arm handle 300, the first and second arms 20, 300 are pivotally connected by an axle pin 60 at a point between the jaws 21, 301 and the handle portions 22, 302. The hand grip squeezing C of the operator is made upon the first and second handle lever portions 22, 302 initially against the resilience of the strut spring 70 until the jaws 21, 301 as they close initially grip the workpiece 80 to be operated within the jaws 21, 301. The strut 40 further pivots around its pivot pin 41 against the strong strut spring 70 as the strut distal end retention pin 42 is driven down the second arm 300 strut cam pin slot 305, the strut distal end cam 45 engaging the smooth strut cam channel profile 306. There resilient portion 304 only bowing according to the level of clenching force C applied as the handles 22, 302 are operated.

The pliers 1 may comprise an intuitive switch locking, unlocking or ratcheting mechanism 500 utilizing less parts than the prior art type tools comprising pivotal struts 40 utilizing toothed cams 43 interacting with a switch 500. The switch 500 usefully now directly incorporates the locking L, ratcheting R or disengaged U teeth 503 mechanism 500 according to their chosen orientation, which can be usefully utilized as required to engage with the teeth 44 of the toothed strut arc 43 to positionally lock as required the same, thereby locking the clamped G workpiece 80 within the jaw portions 21, 303, or alternately disengaging U the switch teeth 503 from the strut toothed cam 43 releasing the workpiece 80 from the jaws 21, 303, according to the pivotal switch 500 orientation.

Figure 3:
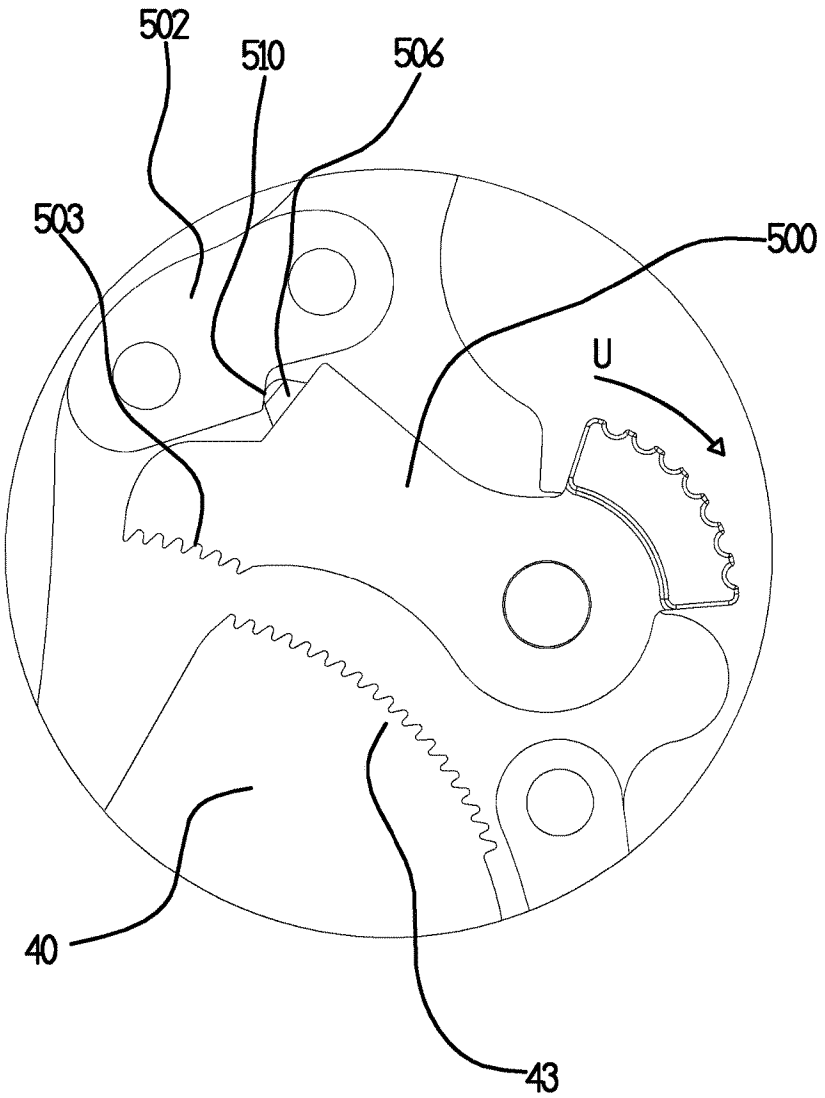
FIG. 3 is a close-up plan view of a switch mechanism of the pliers with the switch shown in an unlocked position.

FIG. 3 shows in close up an intuitive reduced parts count pivotal switch mechanism 500 in its unlocked position U whereas the switch biasing pin 506, actuating end 507 is engaged upon the switch biasing block 502 open profile 510 ensuring that the switch locking teeth 503 are disengaged from the strut cam teeth 44.

The switch 500 locking, unlocking, ratcheting mechanism utilizes less parts than previous pliers type tools comprising pivotal struts 40 with toothed arcs 43 interacting with a switch 500. The switch 500 usefully now directly incorporates the locking L, ratcheting or disengaged U teeth according to their chosen orientation, which can be usefully utilized as required to engage with the teeth 44 of the toothed strut cam 43 to positionally lock as required the same, thereby locking the clamped G workpiece 80 within the jaw portions 21, 301 or alternately disengaging U the switch teeth 503 from the strut toothed cam 43 releasing the workpiece 80 from the jaws 21, 301 according to the pivotal switch 500 orientation.

Figure 4:
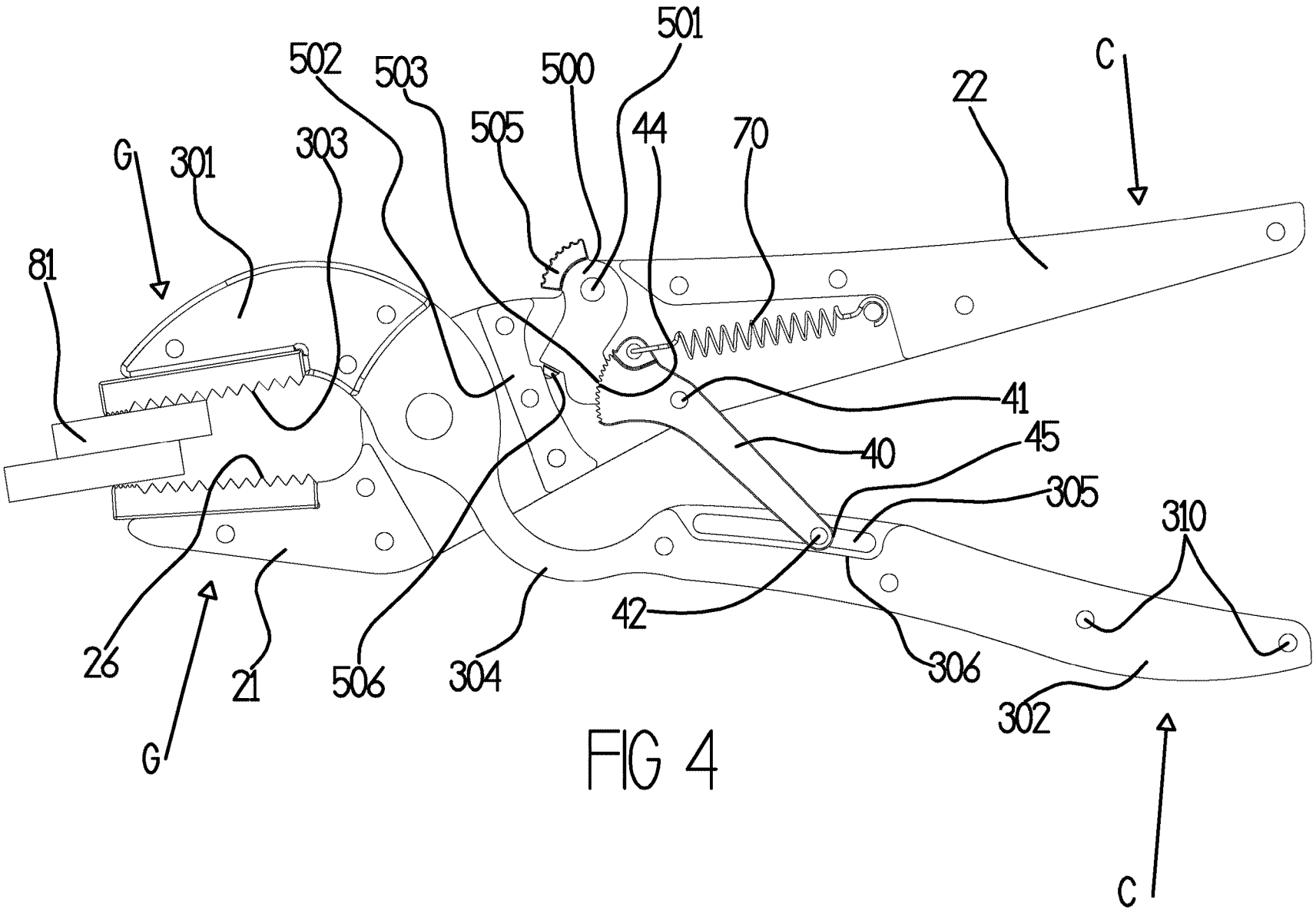
FIG. 4 is a plan view of the pliers gripping a workpiece, with the first and second arm top plates/top laminates shown removed for illustration purposes.

As shown in FIG. 4 in another embodiment the pliers 1 is provided with enhanced jaw 21, 301 closure only after the jaws 21, 301 have first gripped the workpiece 80, 81.

Figure 5:
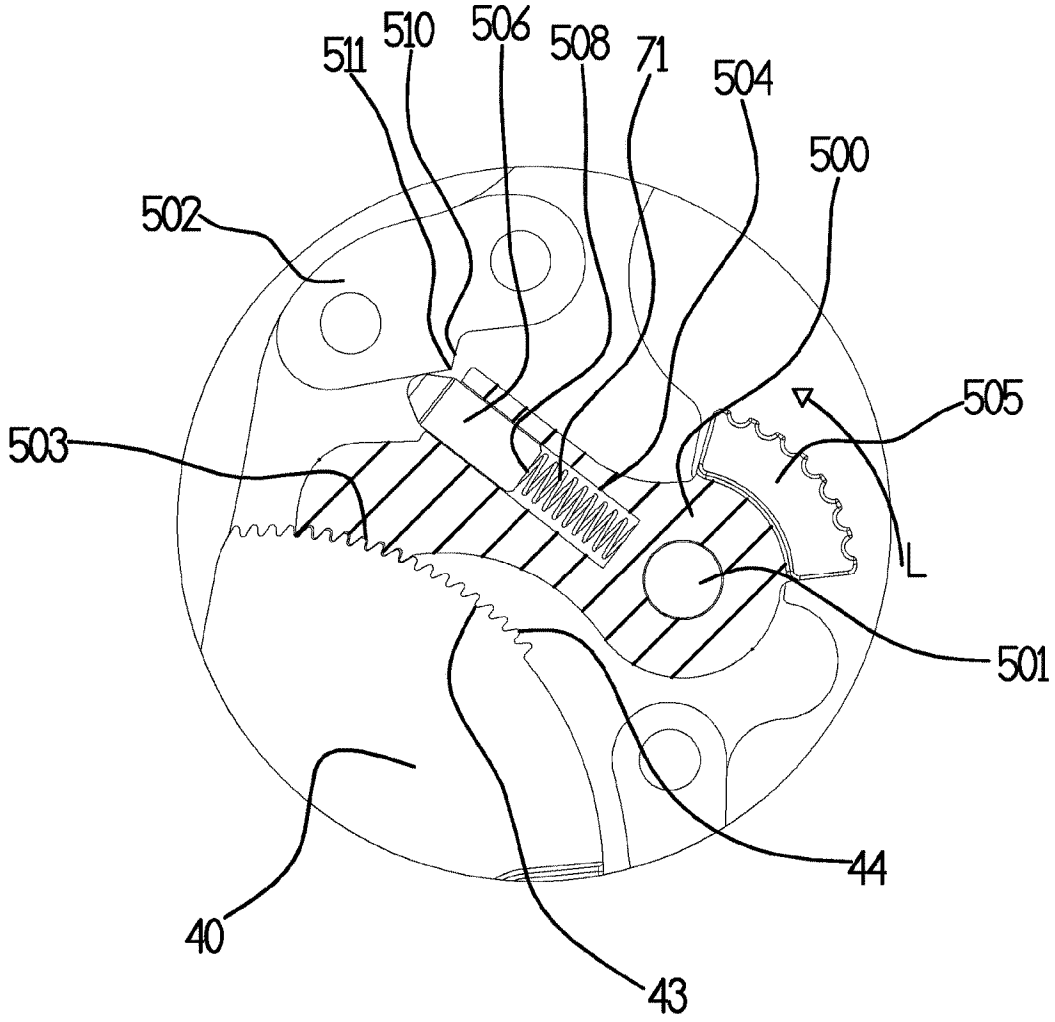
FIG. 5 is a close-up plan view of the switch mechanism of the pliers with the switch shown in a locked position.

As shown in FIGS. 4 and 5 another embodiment of the pliers 1 is provided with a clamping device. There are a myriad of reasons for using such a pliers 1 from clamping and gripping G in order to turn a fastener 80, especially a worn or damaged one to clamping two pieces of metal 81 together prior to welding them. The common failing in the prior art devices is if the clamped object or objects 80, 81 were to reduce their clamp width even slightly for whatever reason the solid grip imparted by prior art devices would result in the failure of the devices ability to sustain further grip upon the objects 80, 81.

In order to overcome these failings, the pliers 1 deliberately incorporates an extremely strong method of resiliently closing or further locking closed the pliers 1 grip via its jaws 21, 301 upon the worked objects 80, 81.

A resilient portion 304 may be provided in the second arm 300 between the second arm levered or jaw portion 21 and the second arm levering or handle portion 302. The profile, material and thickness of the said resilient portion 304 is carefully chosen in order to provide a repeatable resilience with the least chance of stress cracking during repeated use. The profile is in best practice a slow curve or arc 304 in the direction of the closing arm handle 302 force. The flex induced within the living spring portion 304 and the gripping jaws 21, 301 upon the clamped parts 80, 81 is retained by the angle of the strut 40 and the strut distal end cam retention pin 42 within the second arm pin slot 305. The arc 304 and strut 40 locked in position by the strut's 40 engagement with the toothed within the first arm 20 forms a very robust frame, placing the jaws 21, 301 under useful resilient gripping tension. If the clamped parts 80, 81 were subjected to movement or vibration which would defeat the fixed clamping effect of prior art devices the present device 1 would still retain its grip albeit a lesser one. The utilization of a said bowed resilient portion 304 within the first arm 20 providing superior constant said jaw 21, 301 clamping pressure of the part or parts 80, 81 clamped, whilst normally preventing surface damage to the said parts 80, 81. The bowed said bend promoting portion or portions 304 exerting elastic potential energy to usefully spring clamp, the said workpiece 80, 81 between the opposing jaws 21, 301. As even further illustrated in FIG. 4 the retained pivotal strut 40 thereby comprises a base of a triangular elastic potential energy structure A, the resilient portions 304 further comprising the side of the triangle A and the jaw pivot pin 600 as the apex, this formation usefully acts via the connected jaws 21, 301 to provide clamping pressure to the said jaws 21, 301 upon the workpiece 80, 81 this clamping pressure being advantageously resilient in nature.

FIG. 5. shows the switch 500 locking teeth 503 engaged upon the strut toothed cam teeth 44. As the said teeth 503, 44 are saw like in profile the first arm handle 22 and the second arm handle 302 need to be clenched C to finally allow the release of the locking mechanism 500, 43.

Figure 6:
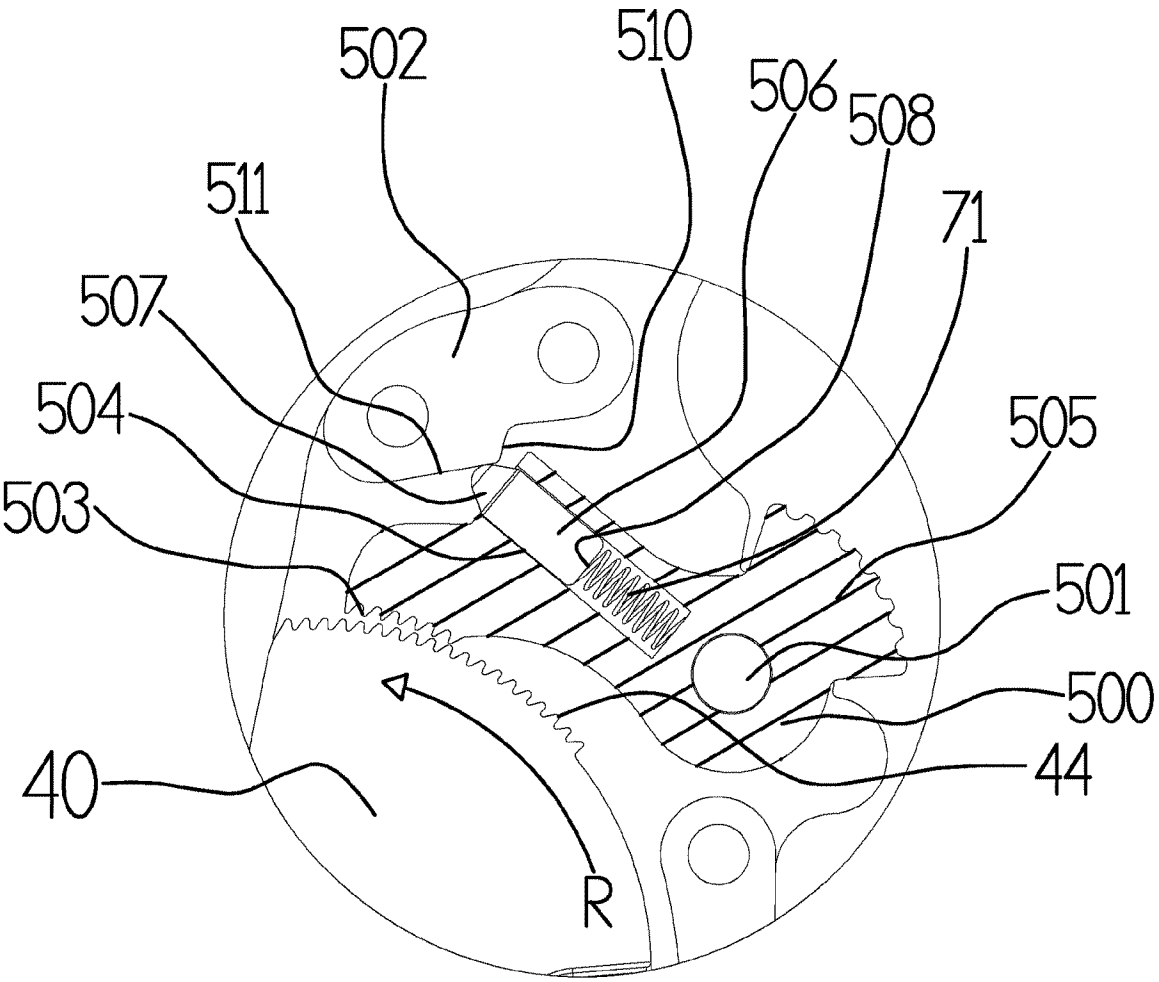
FIG. 6 is a close-up plan view of the switch mechanism of the pliers with the switch o shown in a locked position and the strut teeth ratcheting against the switch teeth.

FIG. 6 shows in close up a further embodiment of the pliers 1 where, in order to provide a method of adjusting the gripping, clamping pressure G exerted by the jaws 201, 202, the pivotal strut 40 is rotatable around the strut pivot 41, when the handles 301, 302 are clenched C closing the jaws 201, 202 upon the workpiece 80 etc. As the handles 301, 302 are further activated, pivoting around the axle pin 60, the pivotal strut 40, toothed strut cam 43 teeth 44 "ratchet" R over the corresponding switch teeth 503 on the switch 500 according to the clenching force C applied. When the operator has reached the level of gripping force G required and releases the applied grip C from the handles 301, 302 the said pivotal strut and switch teeth 44, 503 engage in a locking manner providing the switch 500 is biased in the locking position L. The flex induced within the living spring portions 304 and the clamping G of the jaws 201, 202 upon the clamped parts 80 is retained by the pivotal strut 40 retention by the switch locking teeth 503 upon the strut toothed cam 43 teeth 44. The strut toothed cam 43 strut retention pin 42 is usefully retained as required within the strut cam retention slot 317.

Figure 7:
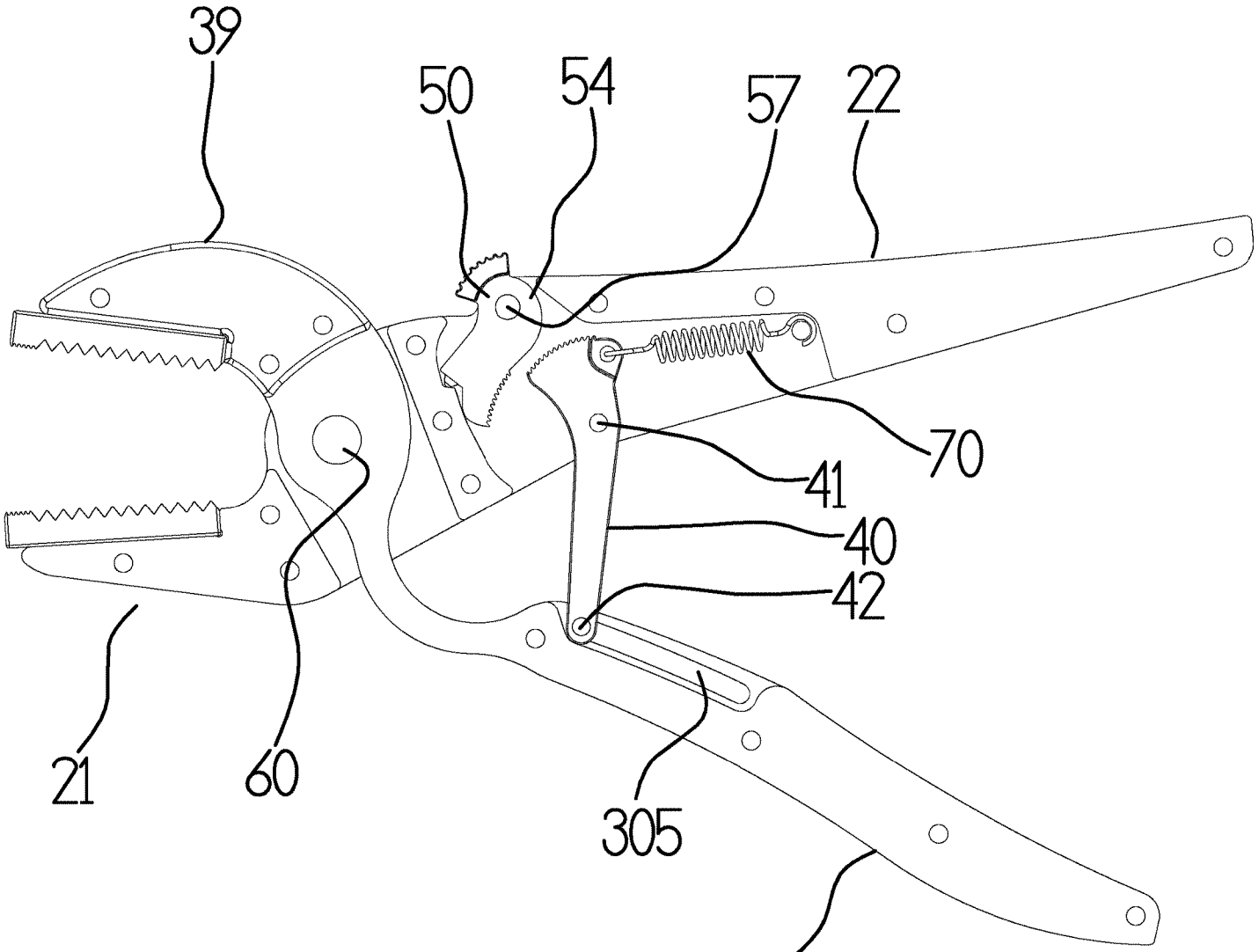
FIG. 7 is a plan view of an embodiment of pliers according to the invention with no deliberate resilient portion fitted, and the first and second arm top plates/top laminates shown removed for illustration purposes.

FIG. 7 another embodiment of the pliers 1 wherein the said arms 22, 302 do not incorporate any said arm resilient portions 304. In all other respects the pliers 1 is as illustrated in FIGS. 1, 2, 3, 4, 5 and 6.

Figure 8:
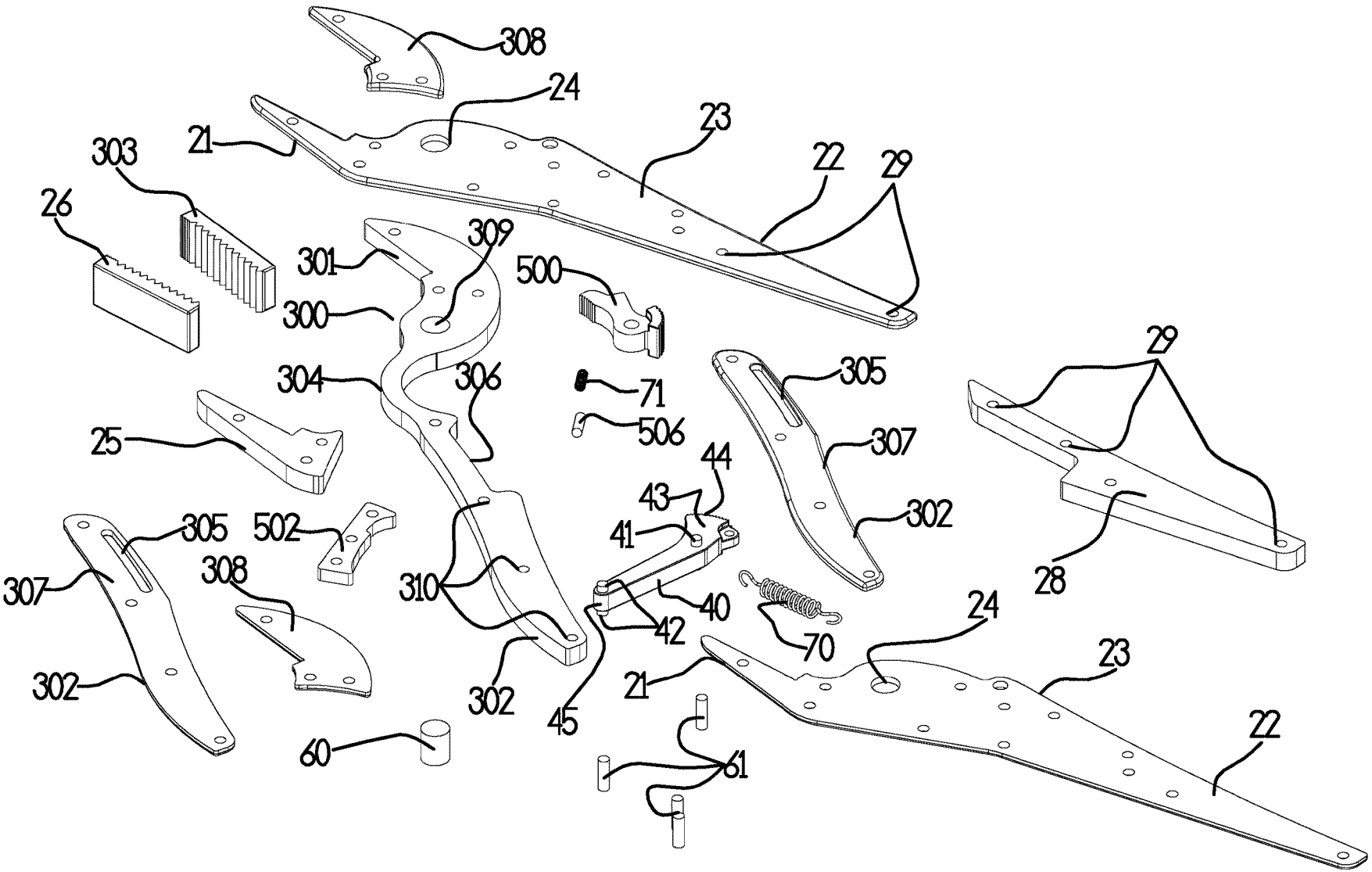
FIG. 8 is an exploded perspective view of pliers according to the invention.

FIG. 8 illustrates the said pliers 1, although the composition could consist of mainly cast or forged parts for example, for cost effectiveness the construction shown comprises a laminate assembly, whereas the parts are shown dismantled for display purposes. Comprising of First Jaw Portion 21, First Arm Handle 22, First Arm Outer Plates 23, First Arm Axle Hole 24, First Arm Jaw Inner 25, First Jaw Gripping Portion 26, First Arm Spacer 27, First Arm Handle Spacer 28, First Arm Assembly Holes 29, Second Arm 300, Second Arm Jaw Portion 301, Second Arm Handle 302, Second Jaw Gripping Portion 303, Resilient Portion 304, Strut Cam Pin Slot 305, Strum Cam Channel Profile 306, Second Handle Outer Plates 307, Second Arm Jaw Outer Plates 308, Second Arm Axle Hole 309, Second Arm Assembly Holes 310, Strut 40, Strut Pivot 41, Strut Retention Pin 42, Strut Toothed Cam 43, Strut Toothed Cam Teeth 44, Strut Distal End Cam 45, Switch 500, Switch Axle 501, Switch Biasing Block 502, Switch Teeth 503, Biasing Pin Bore 504, Switch Actuator 505, Biasing Pin 506, Biasing Pin Actuating End 507, Biasing Pin Spring Abutment End 508, Biasing Block Closing Profile 509, Biasing Block Open Profile 510, Biasing Block Transition Peak 511, Axle Pin 60, Assembly Rivets 61, Strut Spring 70, Switch Spring 71.

The invention claimed is:

1. Pliers comprising:

a first jaw connected with a first handle;

a second jaw connected with a second handle that is pivotally connected to said first handle by a pivot pin extending through said first and second handles; and a locking mechanism for locking said first and second jaws, wherein said second handle comprises an arcuate portion that arches in a direction away from the first handle, wherein said second handle has a length defined between said pivot pin and a free end of said second handle and a width measured in said direction away from the first handle, wherein said width of the arcuate portion of the second handle is at least substantially in the range 5 to 80% less than the width of said second handle outside of said arcuate portion, said locking mechanism comprises a strut pivotally connected with said first handle and having a first end slidingly connected with a groove provided in said second handle and a second end provided with first locking teeth and a switch pivotally connected with said first handle and provided with second locking teeth releasably engageable with said first locking teeth, wherein said switch is provided with a sliding member mounted in a housing defined in said switch and a biasing member configured to bias said sliding member outwardly of said housing, wherein said sliding member is configured to engage a fixed abutment on said first handle and said fixed abutment defines a profile configured such that when said sliding member engages a first portion of said profile said second locking teeth are disengaged from said first locking teeth and when said sliding member engages a second portion of said profile said second locking teeth engage said first locking teeth, and wherein said first and second locking teeth are configured such that when engaged and said first and second handles are squeezed together, said second locking teeth can ratchet over said first locking teeth by sliding movement of said sliding member against said biasing member.

2. The pliers of claim 1, wherein said arcuate portion subtends an angle at least substantially in the range 40 to 140 degrees.

3. The pliers of claim 1, wherein said first and second locking teeth are saw teeth.

4. The pliers of claim 1, wherein said second handle comprises a first end portion that defines pivot hole for said pivot pin and a second end portion that defines said free end and said arcuate portion is disposed intermediate said first and second end portions.

5. The pliers of claim 1, wherein said arcuate portion is disposed closer to said pivot pin than to said free end.

6. The pliers of claim 5, wherein the arcuate portion is situated between said pivot pin and a hand gripping portion of the second handle.

7. The pliers of claim 1, wherein said profile defines a ramp portion connecting said first portion with said second portion.

* * * * *